United States Patent [19]

Fujikawa et al.

[11] 4,287,860

[45] Sep. 8, 1981

[54] TWO-CYCLE ENGINE

[75] Inventors: Tetsuzo Fujikawa, Kobe; Toshiyuki Takada, Miki; Kichiji Misawa, Akashi, all of Japan

[73] Assignee: Kawasaki Jukogyo Kabushiki Kaisha, Kobe, Japan

[21] Appl. No.: 133,373

[22] Filed: Mar. 24, 1980

[30] Foreign Application Priority Data

Mar. 28, 1979 [JP] Japan ..... 54-40813

[51] Int. Cl.[3] ..... F02B 33/04

[52] U.S. Cl. ..... 123/73 PP; 123/73 R; 123/73 A

[58] Field of Search ..... 123/73 PP, 73 R, 73 A, 123/73 B, 73 SC

[56] References Cited

U.S. PATENT DOCUMENTS

| | | | |
|---|---|---|---|
| Re. 27,367 | 5/1972 | Von Seggern et al. | 123/73 A |
| 2,481,901 | 9/1949 | Bracke | 123/73 R |
| 4,075,985 | 2/1978 | Iwai | 123/73 R |
| 4,191,138 | 3/1980 | Jaulmes | 123/73 R |
| 4,242,993 | 1/1981 | Onishi | 123/73 R |
| 4,248,185 | 2/1981 | Jaulmes | 123/73 R |

FOREIGN PATENT DOCUMENTS

| | | | |
|---|---|---|---|
| 2969 | 7/1979 | European Pat. Off. | 123/73 PP |
| 25500 | 10/1952 | Finland | 123/73 A |
| 126266 | 9/1949 | Sweden | 123/73 A |

*Primary Examiner*—Wendell E. Burns
*Attorney, Agent, or Firm*—Jordan and Hamburg

[57] ABSTRACT

A two-cycle engine of the crank chamber preloading type of the construction in which a crankcase, a cylinder head and a cylinder are clamped together by a plurality of clamping members penetrating the cylinder includes a suction port formed in a wall of the cylinder, an exhaust port formed on a side of the cylinder opposite the suction port, at least one main scavenging port disposed between the suction port and the exhaust port and directed toward the suction port, and at least one ancillary scavenging port disposed above the suction port and juxtaposed against the exhaust port. At least one ancillary scavenging passage branching from at least one main scavenging passage and communicating with the ancillary scavenging port extends around an opening for one of clamping members on the suction side.

4 Claims, 7 Drawing Figures

TWO-CYCLE ENGINE

BACKGROUND OF THE INVENTION

This invention relates to a two-cycle engine of the crank chamber preloading type in which a crankcase, a cylinder head and a cylinder interposed between the crankcase and the cylinder head for containing a piston are clamped together and secured in place by a plurality of clamping members, such as bolts, studs, etc., penetrating the cylinder, and more particularly it is concerned with a scavenging system of the two-cycle engine of the type described.

A two-cycle engine of the crank chamber preloading type is known in which a crank chamber defined by the crankcase and a combustion chamber defined by the cylinder, the upper surface of the piston and the cylinder head are made to communicate with each other through at least one scavenging passage. This type of engine is sometimes referred to as a triple-port, two-cycle engine because the cylinder is formed in its wall with three types of openings including a suction port, an exhaust port and at least one scavenging port.

Proposals have hitherto been made to form at least one ancillary scavenging port in this type of two-cycle engine in addition to the scavenging port formed in the wall of the cylinder, for the purpose of increasing the scavenging efficiency of the engine. However, some disadvantages are associated with two-cycle engines of the prior art. In some engines, the provision of an ancillary scavenging port has had no effect in greatly increasing scavenging efficiency. In some engines where scavenging efficiency has been greatly increased by the provision of an ancillary scavenging port, the size and weight of the engines have increased. In some engines, the provision of an ancillary scavenging passage communicating the ancillary scavenging port with the crank chamber has resulted in the need to alter the configuration of the crankcase.

SUMMARY OF THE INVENTION

An object of this invention is to provide a two-cycle engine formed with at least one scavenging port in which an increase in the weight and size of the engine is minimized while the scavenging efficiency of the engine is greatly increased.

Another object of this invention is to provide a two-cycle engine which is free from the need to alter the configuration of the crankcase in spite of the fact that at least one ancillary scavenging port is formed in the engine for increasing scavenging efficiency.

According to the present invention, there is provided a two-cycle engine of the crank chamber preloading type comprising; a cylinder head; a crankcase; a cylinder interposed between said cylinder head and said crankcase; a plurality of clamping members penetrating said cylinder to clamp together said cylinder head, said cylinder and said crankcase; a piston arranged in said cylinder for sliding reciprocating movement; a suction port and an exhaust port formed in the wall of said cylinder; at least one main scavenging port formed in the wall of said cylinder and communicating with a crank chamber in said crankcase via a main scavenging passage; and at least one ancillary scavenging port formed in the wall of said cylinder and communicating with said crank chamber via an ancillary scavenging passage; wherein the improvement resides in that said ancillary scavenging port extends through the wall of said cylinder in a manner to surround the outside of one of said clamping member receiving openings.

Additional and other objects, features and advantages of the present invention will become apparent from the description of the embodiment set forth hereinafter when considered in conjunction with the accompanying drawings.

DESCRIPTION OF THE PREFERRED EMBODIMENT

Prior to description of a preferred embodiment of the invention, two-cycle engines of the prior art formed with ancillary scavenging ports will be described, to enable the principle of the invention to be better understood.

Figure 1:
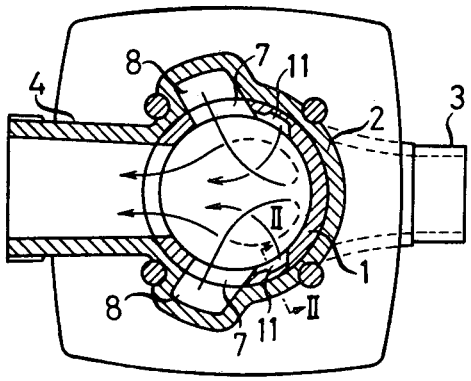
FIG.1 PRIOR ART
FIG. 1 is a horizontal sectional view of a two-cycle engine of the prior art which has ancillary scavenging ports formed on the inner circumferential surface of the cylinder liner.
Figure 2:
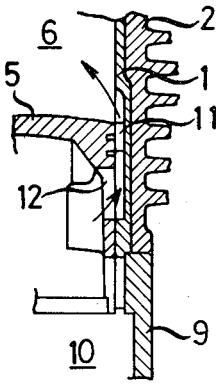
FIG.2 PRIOR ART
FIG. 2 is a vertical sectional view taken along the line II—II in FIG. 1.

FIGS. 1 and 2 show a two-cycle engine disclosed in Japanese Utility Model Publication No. Sho 46-20647 wherein a cylinder 2 including a cylinder liner 1 attached to its inner circumferential surface is connected to a suction line 3 and an exhaust line 4. A piston 5 is slidably fitted in the cylinder 2 as shown in FIG. 2, for reciprocatory movement therein. The cylinder 2, the upper surface of the piston 5 and a cylinder head, not shown, define therebetween a combustion chamber 6. Two main scavenging ports are formed in a wall of the cylinder which communicate with a crank chamber 10 in a crankcase 9 via main scavenging passages 8. Two vertical grooves are formed on the inner circumferential surface of the cylinder liner 1 to serve as ancillary scavenging passages 11. The piston 5 is formed with to windows 12 each of which matches one of the ancillary scavenging passages 11. When the engine operates and the piston 5 moves downwardly in FIG. 2, a current of fuel-air mixture flows from the crank chamber 10 into the combustion chamber 6 via each of the ancillary scavenging passages 11 and each of the windows 12 as well as each of the main scavenging passages 8, to effect scavenging. The currents of scavenging mixture introduced into the combustion chamber 6 are indicated by arrows in FIG. 1.

The fuel-air mixtures introduced into the combustion chamber 6 via the ancillary scavenging passage 11 as described hereinabove pass through the windows 12. As can be seen clearly in FIG. 2, the passages formed by the windows 12 and the ancillary scavenging passages 11 are not smooth and consequently smooth flow of the mixture is unobtainable. Besides, the windows 12 perform a sort of throttling action, so that the amount of mixture flowing through the ancillary scavenging passages 11 is restricted and no great improvement in scavenging efficiency can be achieved. Moreover, since the vertical grooves are formed in the wall of the cylinder 2 or the cylinder liner 1 and used as the ancillary scavenging passages 11, the strength of the cylinder liner 1 is reduced and distortion of the cylinder liner 1 tends to occur.

Figure 3:
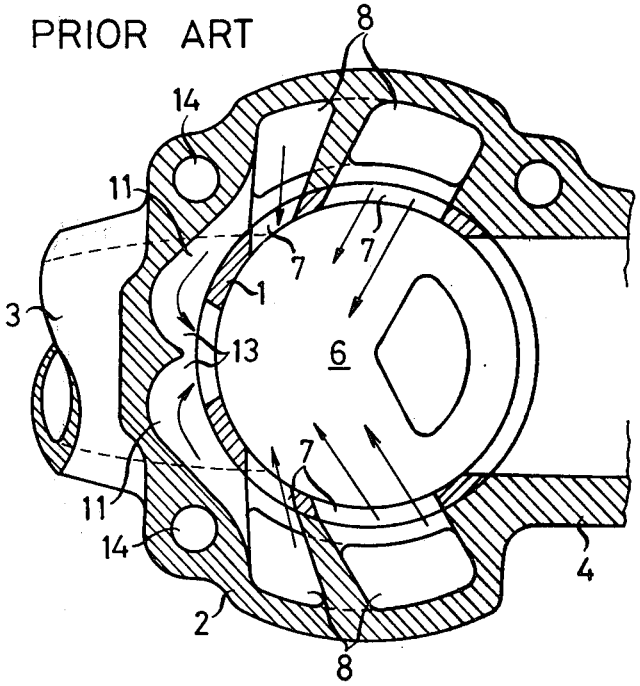
FIG.3 PRIOR ART
FIG. 3 is a horizontal sectional view, with certain parts being removed, of another two-cycle engine of the prior art formed with a plurality of ancillary scavenging passages each extending between the bolt receiving opening and the cylinder liner.

FIG. 3 shows a two-cycle engine shown in Japanese Utility Model Laid Open Publication No. Sho 49-53115, wherein parts similar to those shown in FIGS. 1 and 2 are designated by like reference characteristics and detailed description thereof will be omitted. In FIG. 3, ancillary scavenging passages 11 maintaining the crank chamber, not shown, in communication with the combustion chamber 6 extend horizontally around the outer circumferential surface of the cylinder liner 1 inwardly of openings 14 for inserting clamping members, such as bolts, studs, etc., for clamping together and securing in place the cylinder head, not shown, cylinder 2 and crankcase, not shown. The ancillary scavenging passages 11 each extend through a narrow area between the opening 14 for the clamping member and the cylinder liner 1, so that it is impossible to increase the cross-sectional area of the ancillary scavenging passages 11. As a result, the amount of a fuel-air mixture flowing through ancillary scavenging ports 13 is small and good scavenging effect cannot be achieved. Moreover, since the ancillary scavenging passages 11 are each located in a narrow area, each passage 11 is abruptly bent toward the combustion chamber 6 near the associated ancillary scavenging port 13 opening in the combustion chamber 6. The result of this is that currents of scavenging mixture released from the ancillary scavenging ports 13 impinge against each other and the flow becomes turbulent. This is one of the reasons why it is impossible to greatly increase scavenging efficiency in the prior art.

Figure 4:
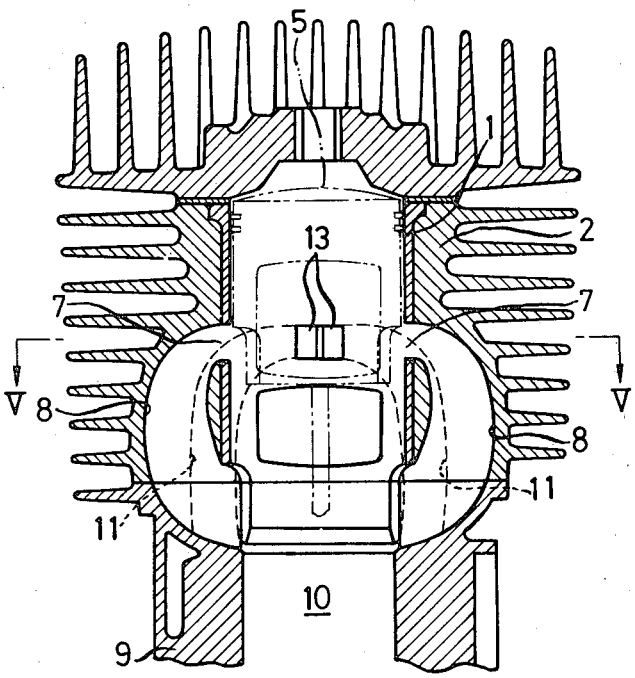
FIG.4 PRIOR ART
FIG. 4 is a vertical sectional view of a further two-cycle engine of the prior art.
Figure 5:
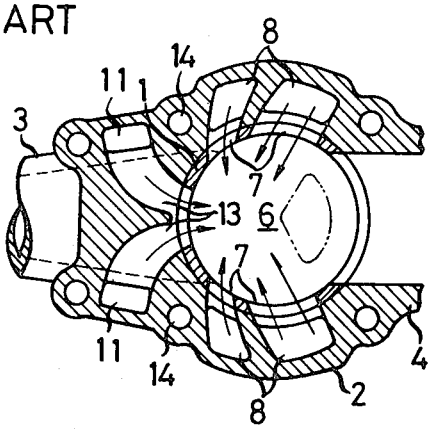
FIG.5 PRIOR ART
FIG. 5 is a sectional view taken along the line V—V in FIG. 4.

FIGS. 4 and 5 show a two-cycle engine shown in Japanese Utility Model Laid Open Publication No. Sho-50-129716 wherein parts similar to those shown in FIGS. 1 and 2 are designated by like reference characters and detailed description thereof will be omitted. In the engine shown in FIGS. 4 and 5, the ancillary scavenging passages 11 each communicating the crank chamber 10 with one of the ancillary scavenging ports 13 extend smoothly. By this arrangement, this engine can achieve higher scavenging efficiency than the engine shown in FIGS. 1–3. However, in this constructional form, each scavenging passage 11 extends through not only the wall of the cylinder 2 but also the wall of the crankcase 9 disposed downwardly of the cylinder 2, and the clamping member receiving openings 14 are each interposed between each ancillary scavenging passage 11 and each main scavenging passage 8, to avoid overlapping of the ancillary scavenging passages 11 and the clamping member receiving openings 14. As a result, the cylinder 2 and crankcase 9 bulge toward the suction side (leftwardly in FIG. 5) and the engine is increase in size and weight. In addition, formation of the ancillary scavenging passages 11 in the wall of the crankcase 9 makes it necessary to alter the configuration of the crankcase 9.

Figure 6:
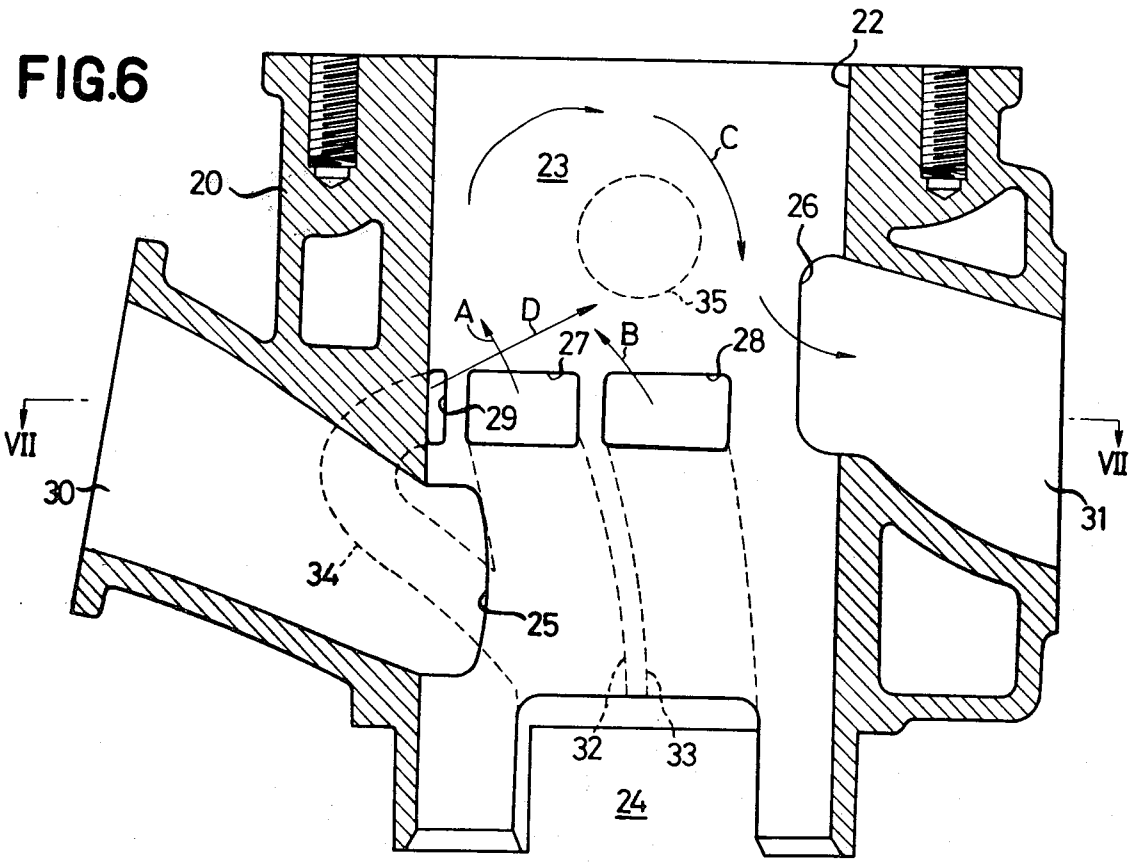
FIG. 6 is a vertical sectional view of the cylinder of the two-cycle engine comprising one embodiment of the invention.
Figure 7:
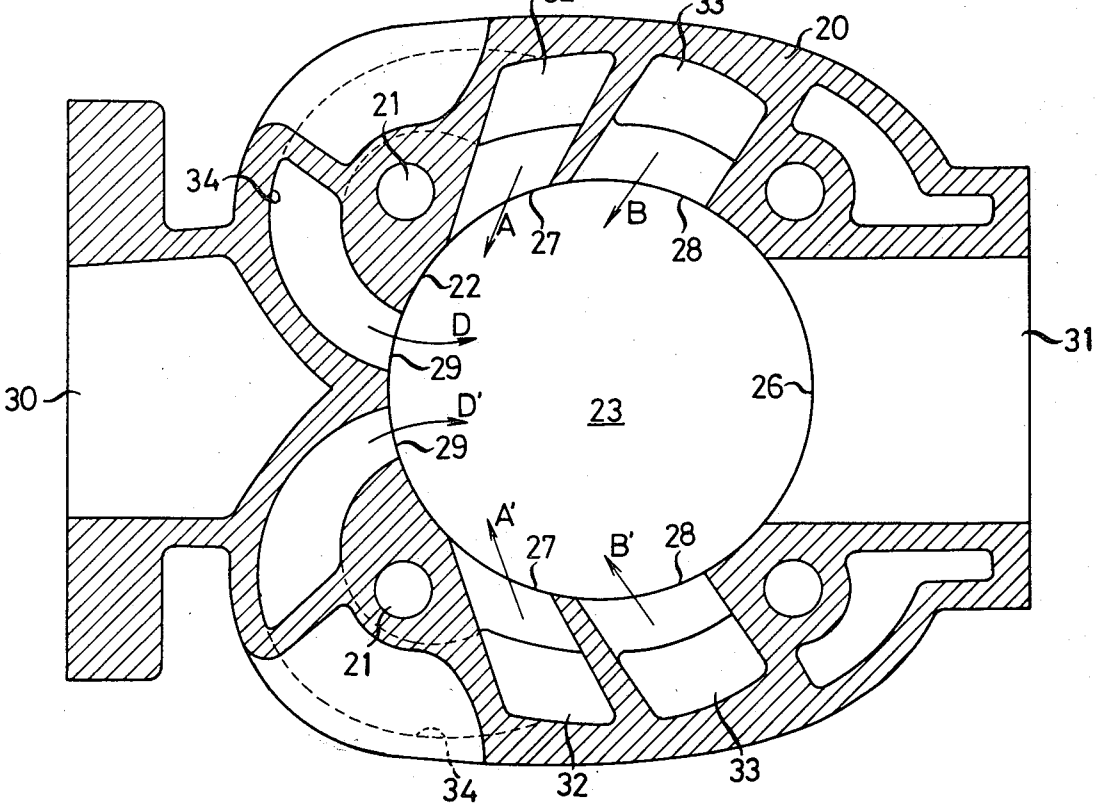
FIG. 7 is a vertical sectional view taken along the line VII—VII in FIG. 6.

FIGS. 6 and 7 show a preferred embodiment of the invention which obviates all the disadvantages of the prior art described hereinabove. A cylinder 20 shown in FIG. 6 has a cylinder head, not shown, located on the top thereof and a crankcase, not shown, located beneath its bottom thereof. The cylinder head, cylinder 20 and crankcase are clamped together and held in place by clamping members, not shown, such as bolts, studs, etc., which are inserted in a plurality of clamping member receiving openings 21 (FIG. 7) formed vertically in the wall of the cylinder 20. A piston, not shown, is arranged in the cylinder 20 for sliding reciprocatory movement. The cylinder 20 includes a cylinder liner attached to its inner circumferential wall. A combustion chamber 23 is defined in the cylinder 20 by an inner circumferential surface 22 of the cylinder, cylinder head and the upper surface of the piston, and a crank chamber is defined in the crankcase (FIGS. 6 and 7 show no crankcase and consequently no crank chamber is shown therein, but the position of the crank chamber is indicated at 24).

In FIGS. 6 and 7, the cylinder is formed on its inner circumferential surface 22 with a suction port 25, an exhaust port 26 disposed on a side of the cylinder 20 opposite the suction port 25, main scavenging ports 27 and 28 disposed between the exhaust port 26 and the suction port 25 and directed toward the suction port 25, and ancillary scavenging ports 29 disposed above the suction port 25 and juxtaposed against the exhaust port 26. The suction port 25 communicates with a carburetor, not shown, via a suction passage 30, while the exhaust port 26 is connected to a muffler via an exhaust passage 31. The main scavenging ports 27 and 28 are maintained in communication with a crank chamber 24 via main scavenging passages 32 and 33 respectively formed in an increased thickness portion of the wall of the cylinder 20.

Ancillary scavenging passages 34 branching from the main scavenging passages 32 in the increased thickness portion of the wall of the cylinder 20 each extend smoothly around the outside of each clamping member receiving opening 21 (a side opposite the center of the cylinder 20 as shown in FIG. 7), and communicates with one of the ancillary scavenging openings 29.

When the engine of the aforesaid construction operates, the main scavenging ports 27, 28 and ancillary scavenging ports 29 are opened by the piston in a scavenging stroke in which the piston moves downwardly. The fuel-air mixture preloaded by the piston in the crank chamber 24 flows therefrom and is released in currents A, A', B and B' through the main scavenging port 28 and 29 into the combustion chamber 23 toward the side of inner circumferential surface of the cylinder 20 on which the suction port 25 is located. Then the currents of mixture flow upwardly and change the direction of flow downwardly in curved streams as indicated by arrows C in FIG. 6, so as to force the combustion gas in the combustion chamber 23 toward the exhaust port 26. Meanwhile ancillary currents of mixture flow through the two ancillary scavenging ports 29 substantially parallel to each other as indicated by arrows D and D' in FIG. 7. The ancillary currents of mixture D and D' perform the function of pushing upwardly a residual mass of combustion gas schematically shown in a broken line position in FIG. 6 toward the exhaust port 26, to promote its expulsion through the exhaust port 26 to atmosphere.

In the constructional form of the invention described hereinabove, the ancillary scavenging passages are each formed in a manner to extend around a clamping member receiving opening for securing the cylinder, cylinder head and crankcase together. This arrangement has the effect of increasing the length of each ancillary scavenging passage in a portion thereof which is connected to the ancillary scavenging port at the end and allowing the current of mixture to be led smoothly prior to its release into the cylinder, thereby greatly increasing scavenging efficiency. The ancillary scavenging passages are formed in a portion of the wall of the cylinder in which wall thickness is not increased more than is necessary and disposed to surround the outside of the clamping member receiving openings, so that bulging of the cylinder due to formation of the ancillary scavenging passages is minimized. The ancillary scavenging passages are each in communication at the inlet portion with the suction side lower portion of the associated main scavenging passage. This eliminates the need to alter the configuration of the cylinder and crankcase in portions thereof at which they are abutted against each other.

What is claimed is:

1. A two-cycle engine of the crank chamber preloading type comprising:

a cylinder head;

a crankcase;

a cylinder interposed between said cylinder head and said crankcase;

a plurality of clamping members penetrating said cylinder to clamp together said cylinder head, said cylinder and said crankcase;

a piston arranged in said cylinder for sliding reciprocating movement;

a suction port and an exhaust port formed in the wall of said cylinder;

at least one main scavenging port formed in the wall of said cylinder and communicating with a crank chamber in said crankcase via a main scavenging passage; and at least on ancillary scavenging port formed in the wall of said cylinder and communicating with said crank chamber via an ancillary scavenging passage; wherein the improvement resides in that said ancillary scavenging port extends through the wall of said cylinder in a manner to surround the outside of one of said clamping member receiving openings.

2. A two-cycle engine as claimed in claim 1, wherein said ancillary scavenging passage is connected to said main scavenging

3. A two-cycle engine as claimed in claim 1, wherein said exhaust port is located on a side of the cylinder opposite said suction port, said main scavenging port is at least two in number with each main scavenging port being disposed between the suction port and the exhaust port and directed toward the suction port, and said ancillary scavenging port is disposed above said suction port and juxtaposed against the exhaust port.

4. A two-cycle engine as claimed in claim 3, wherein said ancillary scavenging port is two in number and arranged in such a manner that the axes of the two ancillary scavenging ports on the inner wall surface of the cylinder are substantially parallel to each other.

* * * * *